US005920297A

United States Patent [19]

Alexander

[11] Patent Number: 5,920,297

[45] Date of Patent: Jul. 6, 1999

[54] FRONT PANEL COLOR ANNUNCIATORS FOR MULTI-CHANNEL INSTRUMENT WITH COLOR DISPLAY

[75] Inventor: Jay A. Alexander, Monument, Colo.

[73] Assignee: Hewlett-Packard Company, Palo Alto, Calif.

[21] Appl. No.: 08/815,777

[22] Filed: Mar. 12, 1997

[51] Int. Cl.[6] ..... G09G 3/32

[52] U.S. Cl. ..... 345/83; 345/151; 340/815.65; 340/815.45

[58] Field of Search ..... 345/85, 30, 39, 345/44, 82, 83, 151; 340/815.45, 815.56, 815.65, 815.66, 815.67

[56] References Cited

U.S. PATENT DOCUMENTS

| | | | |
|---|---|---|---|
| H1320 | 6/1994 | Kieronski | 345/89 |
| 4,768,086 | 8/1988 | Paist | 340/815.65 |
| 4,951,045 | 8/1990 | Knapp et al. | 340/815.65 |
| 5,598,523 | 1/1997 | Fujita | 348/114 |
| 5,684,513 | 11/1997 | Decker | 345/162 |

FOREIGN PATENT DOCUMENTS

508563 A1 10/1992 European Pat. Off. .

*Primary Examiner*—Dennis-Doon Chow

[57] ABSTRACT

A measurement instrument's correspondence between channel controls and selectable trace color on a display is indicated by visual indicators placed proximate the groupings of controls for the different channels. The color of each visual indicator tracks that of the trace corresponding to the channel for that group of controls. In one embodiment a knob located within each group of controls selects a color. Each knob has on its shaft a wheel with colored regions, behind the panel, and only one color shows through a window. Changes in shaft position indicate electrically to the rest of the instrument what color to make the associated display. Another embodiment provides a group of three light emitting diodes (LED's) of primary colors, controls their relative intensities, and then makes their combined light visible upon the front panel, as a visual indicator. Also, small portions of the active region of the display may be covered by the source ends of an optical path for transmitting light. There is a separate optical path for each different visual indicator. The exit end of each optical path is that visual indicator.

7 Claims, 6 Drawing Sheets

FRONT PANEL COLOR ANNUNCIATORS FOR MULTI-CHANNEL INSTRUMENT WITH COLOR DISPLAY

BACKGROUND OF THE INVENTION

Consider a digital oscilloscope with at least two vertical input channels. Since the display is created by raster scan techniques from sampled data stored in a memory, a color CRT or flat panel display can produce a different color for the trace corresponding to each channel. Once this level of functionality is available, it is easy to allow the user to select which color is to be associated with each channel. The justification for such flexibility may be mere preference on the one hand, or it may approach necessity on the other; say, either because of a particular kind of color blindness on the part of the operator or some unusual ambient lighting conditions.

On the other hand, such flexibility raises the issue of whether or not to indicate on the front panel which set of channel controls is associated with each differently colored trace on the screen. That is, suppose that the blue trace has trace excursions that go off-screen, indicating a need to decrease the vertical sensitivity for that channel. Because the correspondence between color and channel is user selectable, it is essentially arbitrary. Absent some indication from the instrument, it is not always possible to quickly and easily decide which is the correct vertical sensitivity control to adjust. Conventional permanently color coded lettering on the front panel is appropriate when the correspondence between channel and trace color is fixed, but not when it is arbitrary.

The ease of use of a sophisticated instrument having selectably different colors for aspects of its operation, and controlled by respective groups of front panel controls, can be enhanced by eliminating the confusion about which group of controls goes with what color results in the display.

SUMMARY OF THE INVENTION

A solution to the problem of indicating the correspondence between channels and color selection is to appreciate that channel controls are generally grouped together on the front panel, and that a visual indicator (resembling say, a large colored dot) placed next to or within the grouping will signal the correspondence if the color of the visual indicator tracks that of the trace corresponding to the channel for that group of controls. So, to adjust the blue trace, one simply steers his hand toward the blue visual indicator. The red trace is controlled by the controls associated with the red visual indicator, and if the color of the red trace is changed to be green instead, the red visual indicator also becomes a green visual indicator, instead.

There are several ways that such a visual indicator of variable color may be implemented. Which is the most appropriate in a given application will depend on several factors, including cost, number of colors and mechanical considerations, such as the amount of space available. Perhaps the simplest way is to have a knob on the front panel that is located within each group of controls to be associated with a color that is in turn selected by turning the corresponding knob. To this end, each color selection knob has on its shaft a wheel with colored regions thereon. The wheel is behind the panel, and only one color shows through a window in the front panel. A switch is also connected to the shaft, and changes in switch position are accompanied by a different color on the wheel showing in the window. The switch indicates electrically to the rest of the instrument what color to make the display or trace associated with the collection of controls associated with the knob. If desired, the color wheel could be transparent and illuminated from behind. This is a simple technique that is appropriate for a small number of colors (say, four to eight) that are fixed ahead of time. The selection of duplicate colors for different channels could be allowed or not, as desired.

A variation on the preceding scheme is to make the color wheel have a continuous change in color and replace the switch with either a shaft encoder or a potentiometer. This allows essentially continuous color selection, but raises the potential issue of how well the color wheel tracks the actual color on the display.

In the case of a digital oscilloscope or other instrument with an embedded control system implemented with a microprocessor there are generally soft keys (a row of keys whose meaning is defined by legends created on the display proximate the keys) or an actual conventional keyboard, and possibly even a mouse or other pointing device. Given this sort of environment the selection of colors can become quite sophisticated, if desired. For example, the intensity of primary colors (or hue and saturation) for each trace could be selected by interacting with the system via a dialog box. Once the various trace colors have been defined to the software of the embedded control system, the question becomes how to replicate those defined colors in visual indicators on the that portion of the front panel having the groups of controls.

One way that can be done is to provide a group of three light emitting diodes (LED's) of primary colors, control their relative intensities, and then make their combined light visible upon the front panel, as a visual indicator. The relative intensities of the LED's can be controlled by duty cycle modulation. Duty cycle modulation may be easier (and perhaps more tolerant of component variations) than controlling actual steady state intensity, although controlled steady state intensity is certainly possible, and we shall discuss some methods of such steady state control. Different groups of LED's make up different visual indicators. The various groups of LED's are controlled by the embedded system through methods the same as or similar to those used to control the various other mechanisms and circuits in the instrument or oscilloscope. This method (using LED's) is particularly appropriate when the display may be separated from the balance of the instrument. Say, for example, the display is produced upon a stand-alone computer monitor that is not contained within the case holding the rest of the instrument.

A final example completes this summary of the invention. Suppose the display is contained within the same cabinet that carries the controls that are to be associated with the visual indicators. Now let a small portion or portions of the active region of the display be covered by a hooded bezel or bezels containing the source ends of an optical path for transmitting light. There is a separate optical path for each different visual indicator, and the exit end of each optical path is a visual indicator. These optical paths may be old fashioned light pipes of bent clear plastic rod, or they may be bundles of fiber optic cable. What makes it work is that each source end is positioned over a preselected and unchanging region of the display that is dedicated to illuminating those source ends, and that is permanently associated with a fixed group of controls. Call these regions of the display "color sources". Each such color source is associated with one optical path, and thus with one visual indicator on the control panel, which is the visual indicator for the group of controls permanently associated with that color source. The following task is then carried out by the embedded control system. Periodically during the formation of the images appearing on the display, the various color sources are illuminated with the same colors as the traces or other displayed information that corresponds to the associated groups of controls. The light thus generated at the various color sources is piped over to the respective corresponding visual indicators, which thus automatically display the (exactly) correct colors.

A visual indicator may have a lens or other cover thereover to increase the viewing angle through which its color may be seen. Additionally, the lens or other cover may be a translucent "button" portion of a push button switch whose function is related to its group of controls; e.g., it could turn its associated trace on or off.

DESCRIPTION OF A PREFERRED EMBODIMENT

Figure 1:
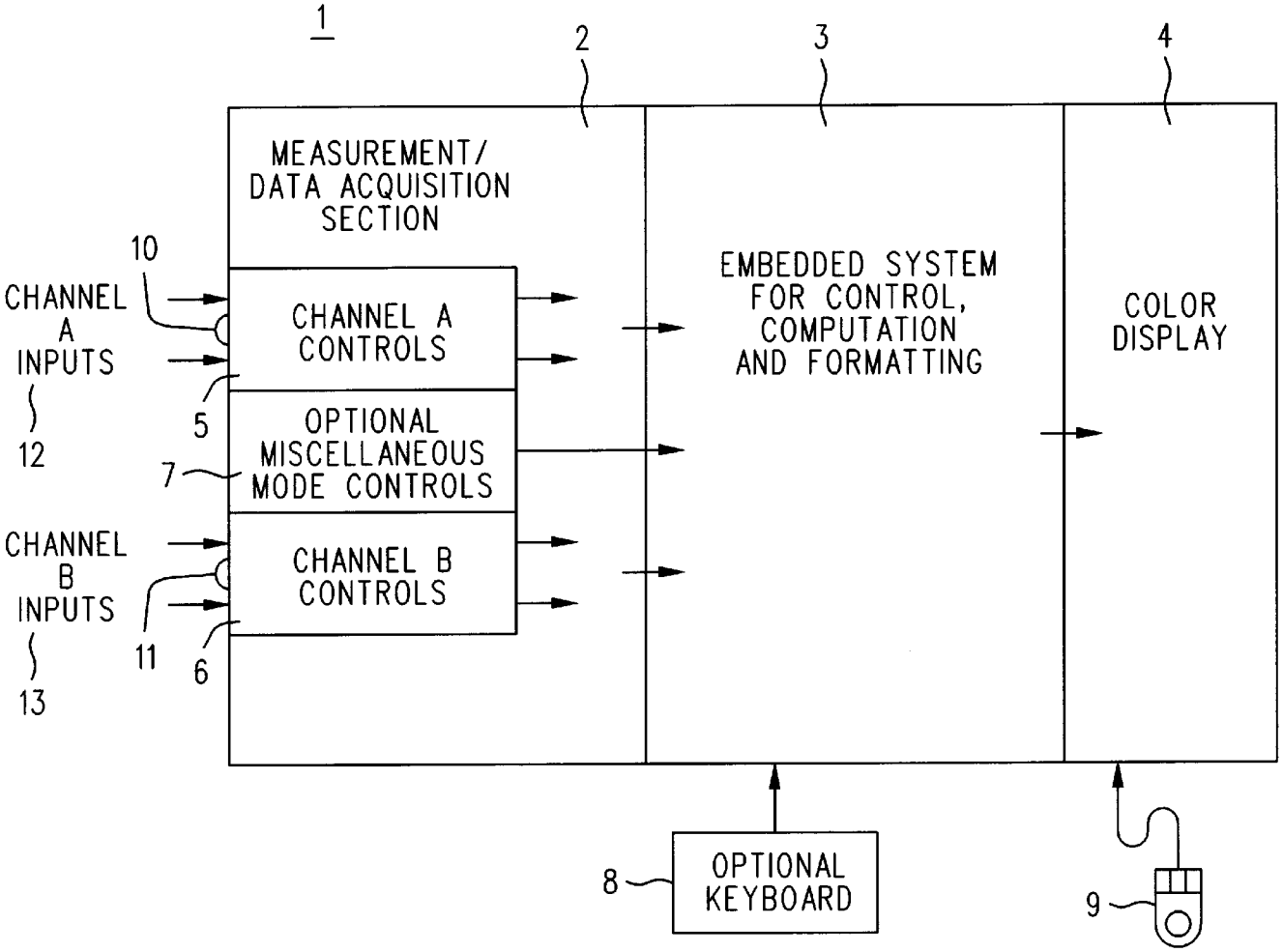
FIG. 1 is a simplified block diagram of an apparatus incorporating variable color visual indicators whose colors reveal the correspondence between data images displayed in different colors and controls affecting individual ones of those images.

Refer now to FIG. 1, wherein is shown a simplified functional block diagram of an apparatus 1 embodying the principles of the invention. The apparatus 1 could, for example, be a digital oscilloscope of the sort having a measurement and data acquisition section 2 that cooperates with an embedded system 3 that controls the apparatus 1, and that performs computations needed to obtain and format results that are presented upon a color display 4. The embedded system 3 could be a unique and special purpose affair developed especially for the tasks at hand, or it could be a commercially available operating system (e.g., Windows 95 from Microsoft) running an application developed specifically to control the apparatus. Generally, it will not be the case that the embedded system is a separate computer, such as a PC; too much interfacing is required between the measurement and data acquisition section 2 and the embedded system 3, and there is a strong desire for the apparatus 1 to be self-contained. However, the color display 4 might be detachable. It might also be a built-in CRT or flat panel display, or it might be a separate monitor of either the PC or workstation variety.

Some prior art oscilloscopes have been constructed as "faceless boxes" that are operated and controlled from a PC. Even though the present emphasis is toward an genuine (and also digital) oscilloscope that has a powerful (internal) embedded system, rather than toward a PC lashed to an oscilloscope-like outboard motor, certain aspects of the invention would still be applicable, even if the system portion 3 were indeed a separate computer.

In an instrument of this type some means of controlling overall configuration and operation is desirable. To that end there may be coupled to the embedded system 3 and optional (computer) keyboard 8 and perhaps a mouse or other pointing device 9. There may optionally also be a collection 7 of miscellaneous mode controls that are simply disposed upon a front panel and are not part of a regular computer keyboard. It may be desirable for one or more variable color visual indicators to be associated with one or more of the controls in the collection 7.

The measurement and data acquisition section 2 also includes a group or collection of Channel A controls 14 that are coupled to Channel A inputs 12, and a group or collection of Channel B controls 6 coupled to Channel B inputs 13. In the case of an oscilloscope the channel controls would include such items as a coupling selection switch, calibrated vertical sensitivity control, sensitivity vernier, polarity control (which of + or − is upwards in the trace), etc. In accordance with the invention, the apparatus 1 (which need not necessarily be an oscilloscope, but might also be a logic analyzer or something else) also includes in each collection of channel controls (of which there might also be more than two) a visual indicator (10, 11).

It will be appreciated that some image or images appear on the color display 4 that represent whatever it is that is being measured or analyzed. The user of the apparatus 1 is given the ability to declare or select what color the A channel data is to appear in, and what different color the B channel data is to have. These selections may be arbitrary. It is the function of the visual indicator 10 to visually exhibit the color selected for the image corresponding to the A channel data. Visual indicator 11 is to visually exhibit the color selected for the image corresponding to the B channel data.

And although we have not shown it in FIG. 1, it will be appreciated that there are other group of controls that may exist, but that are not properly labelled with the term "channel". An example might be the horizontal time base controls for an oscilloscope, or the frequency axis of a spectrum analyzer. One can appreciate that it can be useful for these controls to have variable color visual indicators associated therewith, as well. For example, the oscilloscope feature known as delayed sweep often incorporates in a single color (monochrome) scope an intensification of the segment of the trace that will be subject to expansion at a higher sweep speed. In a scope with multi-color traces that intensified segment might instead be a different color, or perhaps be the same color but blinking. The color corresponding to the segment to be expanded could then appear in a variable color visual indicator associated with controls pertaining to the horizontal time base, which is where that aspect of the oscilloscope's operation is controlled.

Figure 2:
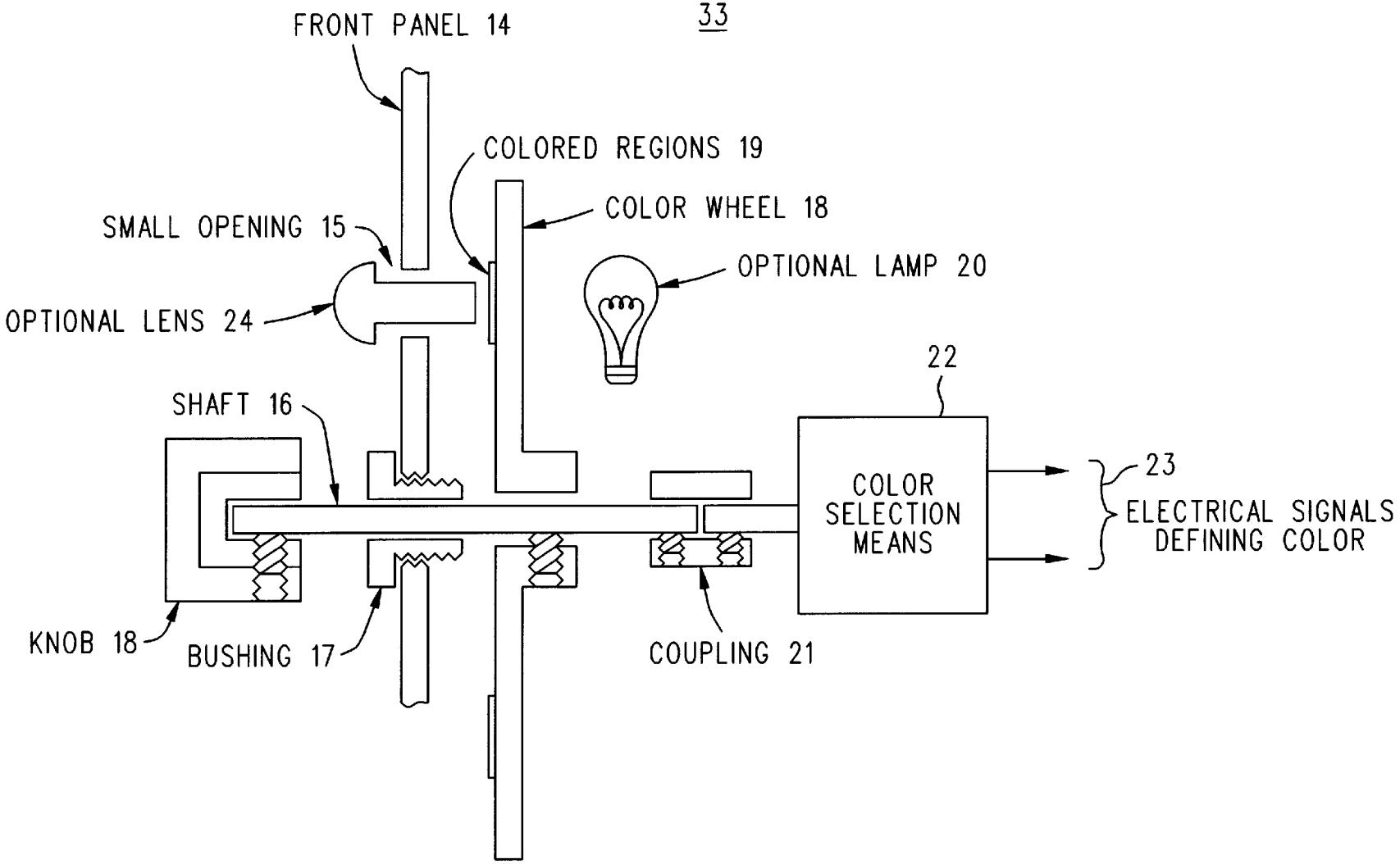
FIG. 2 is a simplified electromechanical diagram illustrating one embodiment of the variable color visual indicators of FIG. 1.

We turn now to an exposition of different ways that a variable color visual indicator, such as is described above, may be implemented. Refer now to FIG. 2, wherein is shown a simplified partial cross sectional view of an electromechanical embodiment 33 of a variable color visual indicator suitable for use in an apparatus 1 as described in connection with FIG. 1. In FIG. 2 a front panel 14 has a small opening 15 therein, behind which is disposed a color wheel 18 having thereon various colored regions 19. The color wheel 18 is mounted on a shaft 16 that extends beyond the front panel 14 through bushing 17 to end in a knob 18. The other end of the shaft 16 engages a color selection means through a coupling 21. If the color wheel 18 and its colored regions are translucent, an optional lamp 20, in line with opening 15 but behind the wheel, may be present to provide radiance. If the lamp 20 is present it may also be desirable to include an optional lens 24 that both acts as a light conduit to conduct colored light from the color wheel 18 out beyond the surface of the front panel 14, and as a means to increase viewing angle. Absent lamp and lens 24, the color wheel 18 could simply be viewed in the ambient light otherwise available, or perhaps be illuminated internally from the direction of the front panel. It will also be appreciated that the separate shaft 16 and associated coupling 21 might be unnecessary if a long enough shaft extended from the color selection means 22 in the first place.

It will be appreciated that knob 18 and opening 15 (and optional lens 24) are located in the midst of, or proximate to, the various controls that affect the displayed image that is to be in the color selected.

Color selection means 22 may be rotary switch, having say, eight positions delimited by detents. These eight positions may correspond to eight distinct and determined in advance colors, or seven such colors and "OFF". (OFF would mean that no trace corresponding to that channel is to be generated.) Alternatively, if lamp 20 is present the OFF condition could established by another control and could be represented in the visual indicator by simply extinguishing the lamp; this would leave each switch position free to represent a different color. The rotary switch produces a pattern of electrical signals 23 that define to the embedded system 3 the color selected by the user of the apparatus 1.

Thus, the embodiment 22 shown in FIG. 2 has the property that it both defines the color and indicates that definition as a region of color on the front panel in a location associated with the controls that affect the image displayed in the selected color. It is an issue of manufacturing tolerances and calibration to ensure that the color of the trace on the display and the color visible through the opening 15 in the front panel 14 are sufficiently similar.

Certain variations on the embodiment 33 of FIG. 2 are possible. First, the color selection means 22 need not be a switch with discrete positions. It might be either a shaft encoder or a potentiometer. A shaft encoder approximates a continuous adjustment, an a potentiometer actually provides one. The nature of the electrical signals and how they would be processed would, of course, change in ways appreciated by those skilled in the art. The color wheel 18 could then receive a continuously changing colored region 19.

Figure 3:
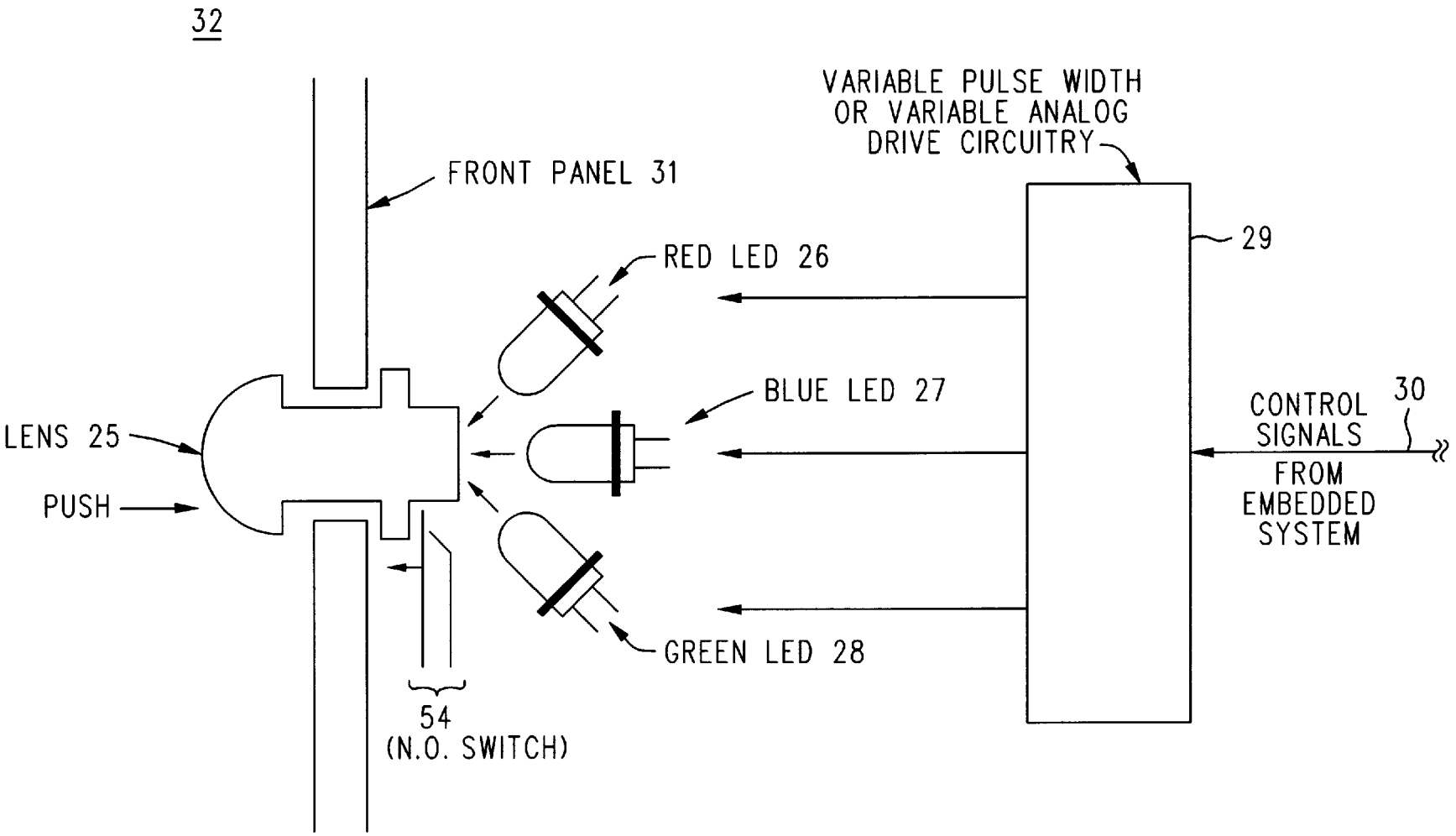
FIG. 3 is a simplified block diagram illustrating an electrical embodiment of the variable color visual indicators of FIG. 1, wherein the variable color visual indicators include LED's of primary colors operated at varied intensities.

Refer now to the embodiment 32 shown in FIG. 3. In this embodiment a front panel 31 carries a lens 25 that serves to increase the viewing angle, keep dirt and other debris away from the LED's to be described next, and perhaps also to assist in combing the light therefrom. Near the back side of lens 25, on the inside of the front panel 31, are disposed three LED's 26, 27, and 28. While we have shown the LED's 26–28 as separately packaged components, it will be understood that they could also be combined into a single package. Also, one might use colored incandescent lamps in place of LED's. Each LED emits light of a primary color (e.g., colors that when combined in different proportions of intensity, appear to produce other colors in the spectrum of colors visible to a human eye). Red, blue and green are one example of such primary colors. The uniform mixing of the colors as they pass through the lens 25 to a viewer's eye may be assisted if one or both ends of the lens 25 is slightly frosted, or otherwise treated to diffuse light.

Optionally, lens 25 may also serve as the actuatable portion of a push button switch 54. In the example shown in the figure the resilient contacts of the switch mechanism bias the lens 25 outward, and the contacts themselves are normally open. It will be understood that this arrangement is merely illustrative, and that a variety of other configurations for mechanical bias and electrical contact arrangement are possible. Furthermore, the switch might instead be of the latching "push-push" variety, instead of the momentary action shown. Also, the function performed by actuating the switch may vary according to the nature of the instrument. In an oscilloscope the function of such a switch could be to turn an associated channel and its trace ON or OFF.

It will be further appreciated that the translucent switch cover described above may be used in conjunction with other types of variable color visual indicators besides the LED arrangement of FIG. 3. That is, it could be adapted to work in the arrangement of FIG. 2 or of FIG. 4.

What is needed now is a circuit mechanism 29 to regulate the relative apparent intensities of the light from the three LED's 26–28 according to control information 30 from the embedded system 3. One could regulate their actual steady state intensities. Suppose that each LED had an associated eight bit register to which the embedded system wrote an intensity value for the primary color represented by that LED. Assume that the voltage levels for the register are high enough to drive the LED and that outputs can either source or sink the current necessary. Then there are several ways that the value in the register could be used to control the brightness of the diode. The first of these would be for each bit position to represent some arbitrary brightness. The LED is coupled to each bit position by an associated drive resistor. Only one bit position at a time illuminates the LED, and the value of the associated drive resistor sets the associated brightness level. This produces nine levels; off (no bits set) and eight different levels of actual illumination. A variation is for the LED to serve as a summing junction, and let it add the currents contributed by any of the bit positions. Now there are two hundred fifty-six levels of illumination for that LED. The different bits could be assigned increasing amounts of drive, so that some bits are essentially a coarse adjustment and others medium while still others act as a fine adjustment.

If the register cannot drive the LED's directly, then the register could drive a genuine Digital to Analog Converter (DAC), which in turn drives the associated LED. Or, the register could drive a one of N-line decoder whose outputs activate the LED through intervening drive resistors.

Another solution for controlling the LED's 26–28 is to drive each diode with pulses of variable duty cycle. When a diode is pulsed on it is always on at full brightness for the duration of the pulse. The apparent brightness according to the eye, however, is averaged through response time and persistence (both of which are in the eye—the diodes emit clean rectangular pulse of bright light) and appears to vary according to the duty cycle.

Thus, another way to drive the LED's 26–28 is with a collection of circuitry that can accept digital command information from the embedded system 3 and drive the diodes with the indicated duty cycles. The repetition rate for the complete duty cycle needs to be fast enough to avoid flicker and interaction with other light sources (e.g., fluorescent light fixtures). Seventy to one hundred cycles per second are a reasonable lower limit; the upper limit is one of practicality for the interface to the embedded system and the chosen drive technique.

For example, one may connect a shift register in a circular configuration, such that what is shifted out the end is shifted back in at the input. Commercial TTL shift registers are readily available in lengths of four and eight bits with parallel load. For example, two eight-bit shift registers may connected as a sixteen-bit circular shift register; one of the bits is selected to drive the LED associated with that shift register. After the appropriate pattern is loaded into the shift register shifting is begun at some frequency high enough to ensure that no flicker ensues. Let's say that a logic one lights the LED when that one is shifted into the bit position that corresponds to the LED. Then a loaded pattern of all zeros produces minimum (zero) intensity in the LED. A pattern of all ones produces maximum intensity. Other patterns produce apparent intensities according to the ratio of the number of ones to the number of zeros in the pattern. A single one with fifteen zeros would produce an apparent intensity of one sixteenth of full intensity. Two ones and fourteen zeros (intermixed in any order) will produce an apparent intensity of one eighth of full intensity. Three ones and thirteen zeros would produce three sixteenths full intensity, and so on. In this example arrangement the range of zero to full apparent intensity is available in discrete steps of one sixteenth. For a system of three primary colors, where each LED is driven by its own shift register, this would allow $16^3$ different color/intensity combinations. Some of these combinations will be for the same apparent color, but at different intensities. For example, if the subscripts i, j and k represent duty cycles in percentage, and R, G and B are primary colors respectively having those duty cycles, then $R_i$, $G_j$ and $B_k$ and $R_{2i}$, $G_{2j}$ and $B_{2k}$ represent the same color at two different intensities, provided the subscripts remain realizable (within the range of zero to one hundred percent). A more general case is described when the constant 2 in the preceding example is allowed to be any suitable positive constant.

The shift registers and their controlling logic could be individual IC's of the commercial variety, or their functionality could be synthesized by a programmable gate array. The latter approach has the desirable effect of minimizing the package count.

Of course, there are yet other ways the LED's 26–28 could be controlled. They could be driven by programmable astable multi-vibrators or by repeatedly re-triggered one shots with programmable pulse widths.

Figure 4:
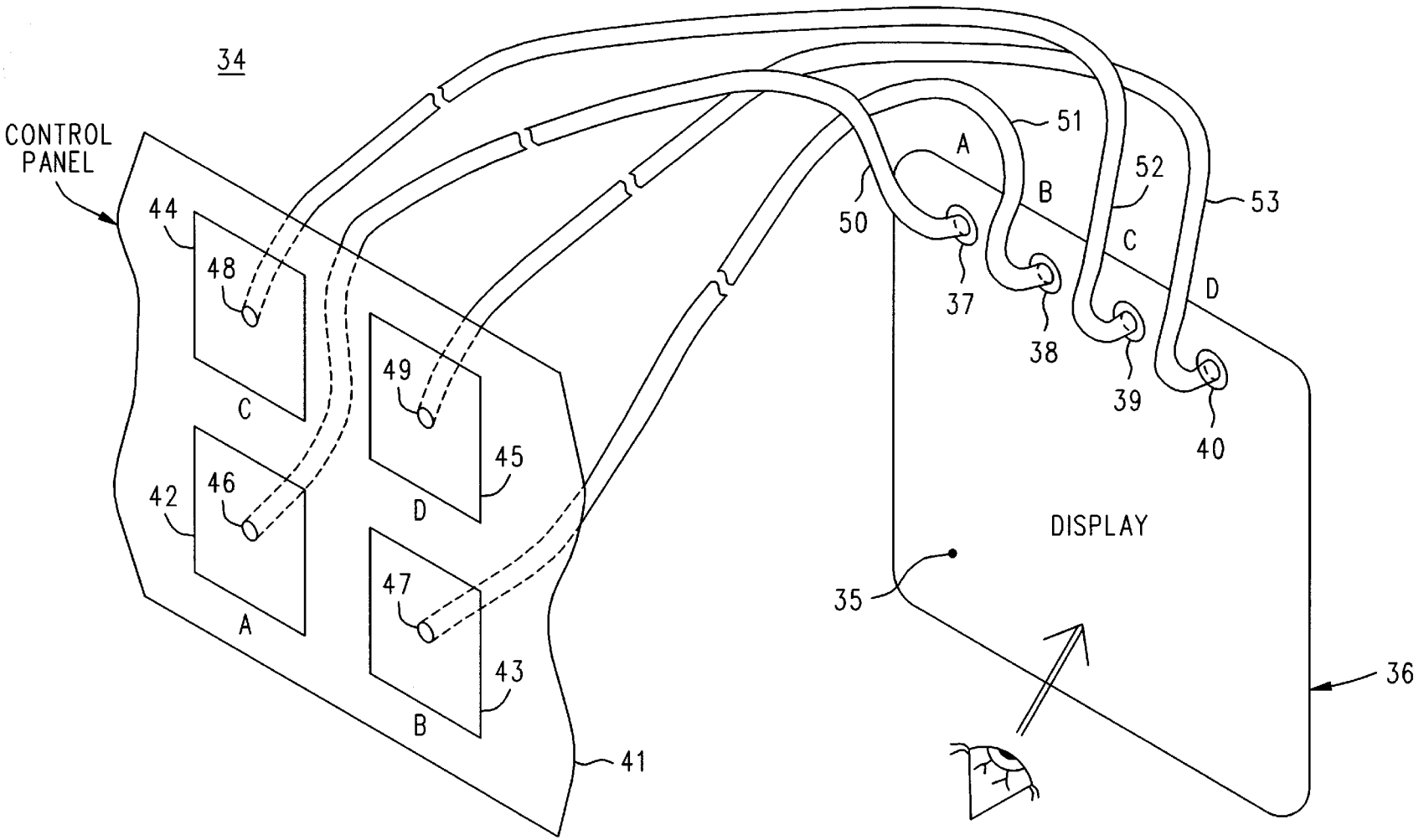
FIG. 4 is a simplified exploded pictorial view of an optical-mechanical embodiment of the variable color visual indicators of FIG. 1, wherein the light for each variable color visual indicator originates upon the display and is conducted through an optical path to exit at a visual indicator on the front panel.

As a final embodiment of how variable color visual indicators can be obtained, consider the embodiment 34 illustrated in FIG. 4. In this embodiment a color display 35, which may be either a CRT or a flat panel display, has a usable region indicated by the line 36. By usable region is meant that the embedded system 3 can cause images, whether of data or control information, to be formed anywhere within that region 36. The notion (set out below) that a small portion of usable region 36 may be set aside for some special purpose, leaving the remaining screen free for all other purposes is consistent with that definition. That is, if that small portion were obscured, say by a bezel, and could not be seen by the user, the user would then think that the visible screen available was something less than our definition above. That is quite all right; what it means is simply that the user's conception of the screen would then be slightly different from the system designer's conception.

To continue then, shown also in the figure is a section of a control panel 41, which may be a "front panel" of some measurement instrument, such as an oscilloscope. Suppose, for the sake of example, that it is indeed an oscilloscope, and that it has four vertical inputs labeled as channels A, B, C and D. Closed lines 42–45 respectively indicate each general extent of groups of front panel controls that would be associated with each of the channels A–D. For the sake of clarity, the controls themselves (whatever they would be) are not shown. What is shown in each of the regions bounded by lines 42–45 are respective variable color visual indicators 46–49, each of which indicates the color that data on the screen or display 35/36 those controls within the region are associated with.

Now return to the notion that a small portion of the usable region 36 is set aside for some special purpose. In our example in FIG. 4 the small usable portion is implemented as the four color source regions 37, 38, 39 and 40 along the top of the display 35. Color source regions 37–40 may be circular, square, rectangular, or any other desired shape. They need only be large enough that they may be ensured of being in alignment with their respective optical paths 50, 51, 52 and 53, and probably also that when in alignment, the entire entrance of each optical path lies within the boundaries of the associated color source region. The optical paths 50–53 may be bundles of optical fibers, or, light pipes of glass or plastic. Each has an entrance end that abuts its associated color source region. Each is routed to the location on the panel 41 having the corresponding color visual indicator 46–49. At the color indicator end the optical path may terminate in a lens or diffusion mechanism to increase the viewing angle and keep grime from accumulating on the exit end of the optical path, or to at least make it more readily cleaned if it does.

The location of the color source regions 37–40 may be chosen differently according to the circumstances. It may be desirable to locate then in the corners of the display 35, or in a strip along one edge closest to the panel having the variable color visual indicators. It will probably be desirable to cover the optical paths 50–53 and the portion of the display having the color source regions with a bezel. For the sake of clarity the bezel has been omitted from the drawing, but it will be appreciated that a bezel not only makes the display more attractive, but mechanically protects the optical paths and prevents stray light from entering them.

Thus, it can been seen that in the four channel example of FIG. 4 the A channel has associated therewith color source region 37, optical path 50 and visual indicator 46 that lies within the confines of the group of controls for the A channel delimited by line 42. It will be understood that such a delimiting line may or may not actually appear on an actual front panel. A similar arrangement exists for the remaining three channels B, C and D.

The embedded system 3 keeps track of which color has been assigned to represent the A trace or data. (It does this anyway.) What it now does in addition is to illuminate color source region 37 with that same color. That in turn causes the visual indicator 46 associated with the A channel to emit some of the light originating with color source region 37, which is of course, EXACTLY the color used to represent channel A. In the same way the embedded system 3 illuminates the other color source regions 38–40 with the colors selected to represent data for channels B, C and D, respectively. This causes the visual indicators 47, 48 and 49 to glow with their respective selected colors. A channel that is not in active use ("turned off") may have its corresponding color source region illuminated or not, as seems most fitting.

Figure 5A:
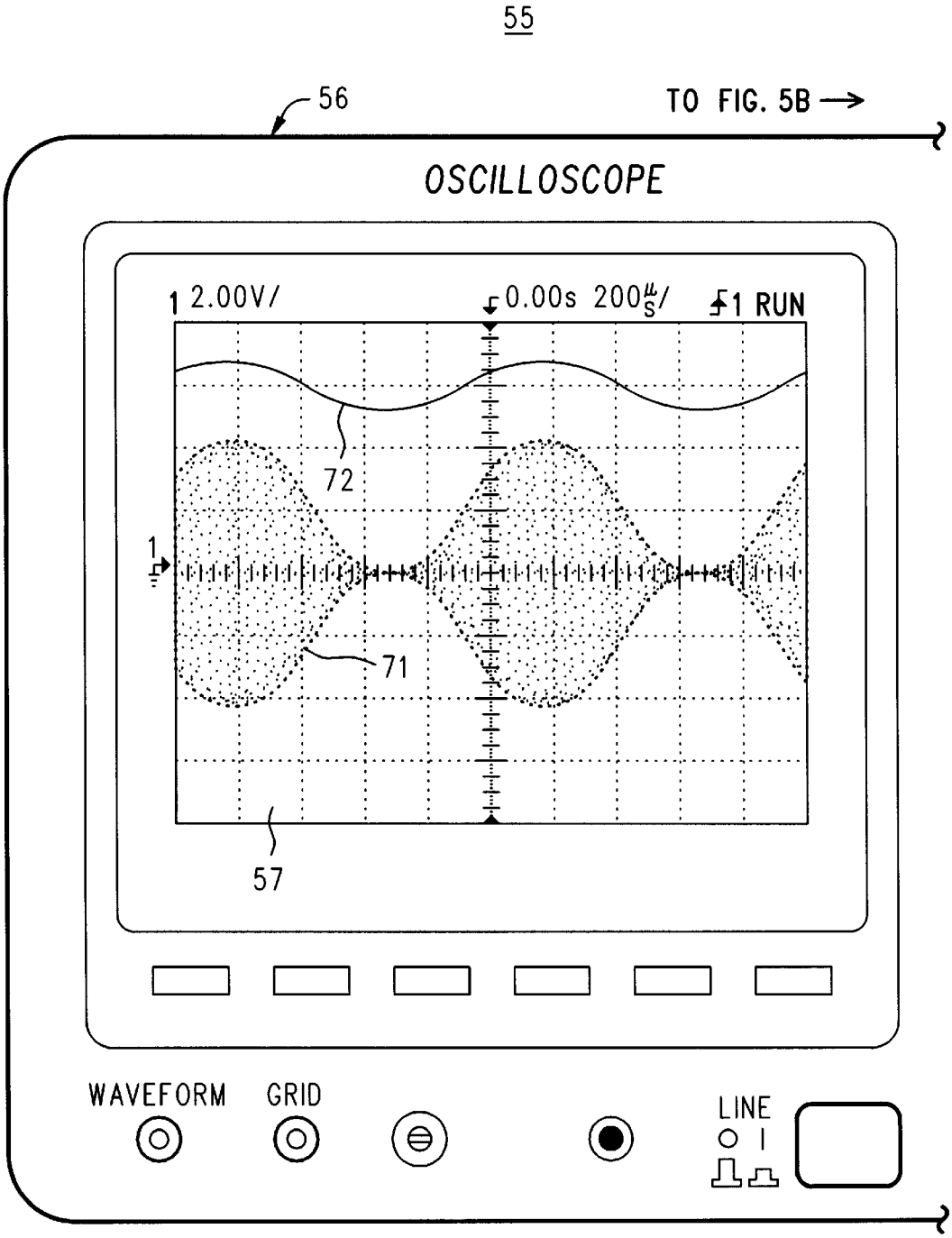
FIGS. 5A–B are a line drawing of an example oscilloscope having different color traces for each channel and variable color visual indicators on the control panel to indicate what color trace is controlled by each group of controls.
Figure 5B:
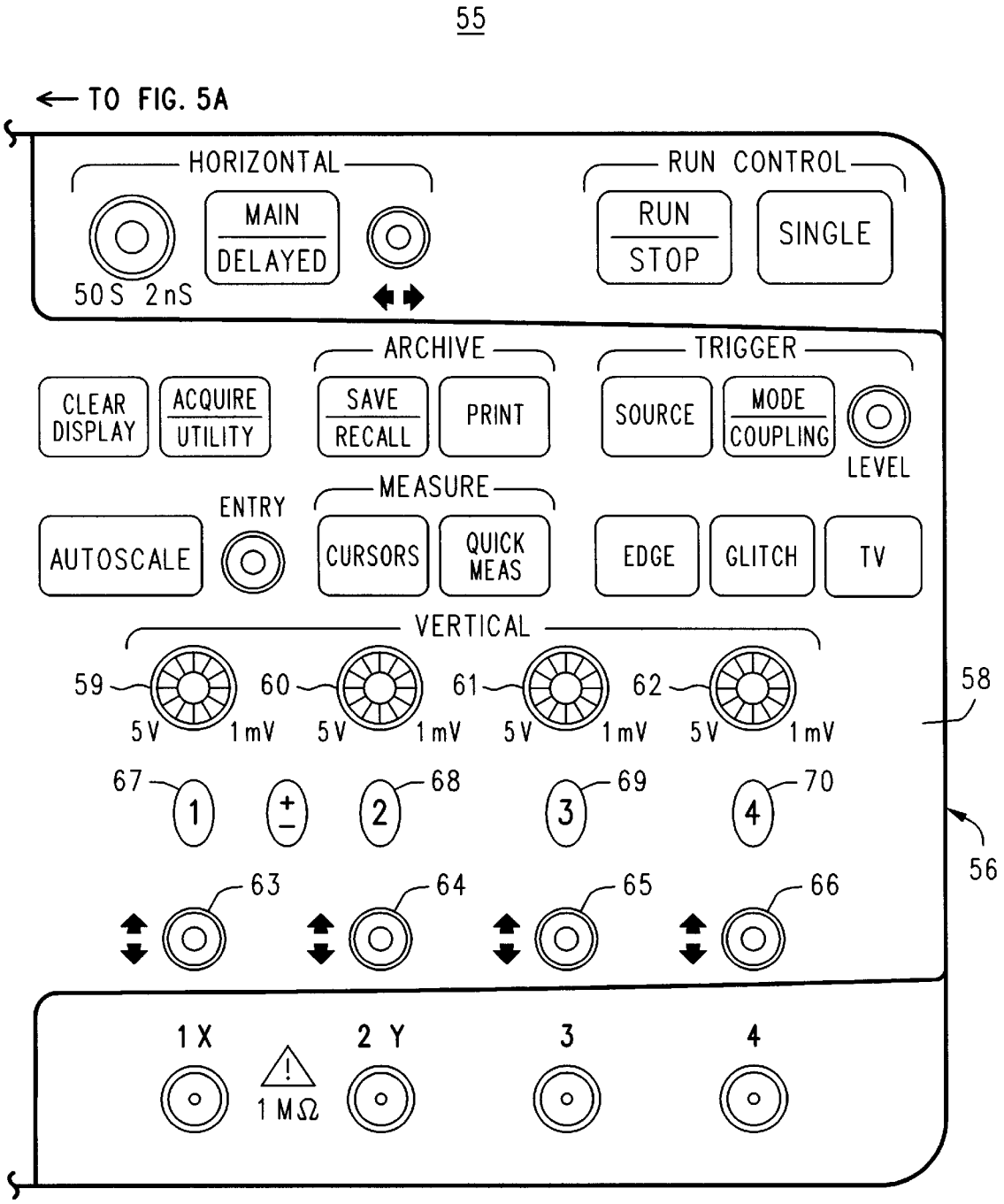

Refer now to FIGS. 5A–B, wherein is shown a front view 55 of a four channel oscilloscope 56 having traces of different colors and that incorporates variable color visual indicators. In particular, there is a multi-color display 57 upon which there may appear a plurality of traces corresponding to the channels in use, and a control panel 58 having groups of controls that affect those traces. In the present example the four input channels are named "1", "2", "3" and "4". The groups of controls for these channels are adjacent vertical collections, and include, for example, respective sensitivity controls 59–62 and respective position controls 63–66. Of particular interest in FIG. 5B are the variable color visual indicators 67–70. They not only indicate the trace color for their channel, but are also push button switches that turn their associated channels ON and OFF.

Now assume that trace 72 is displayed in green and represents the signal applied to channel 1. Then variable color visual indicator 67 will glow green. Assume that trace 71 is displayed in blue and represents the signal applied to channel 2. Then variable color visual indicator 68 will glow blue. Assuming the other two channels are OFF, then variable color visual indicators 69 and 70 will probably be unilluminated. That way, if one were illuminated (say, visual indicator 69 were yellow) and no trace of that color (yellow) were visible it would mean that some adjustment of the controls was needed. (That is, perhaps the trace is positioned off screen or the scope is not triggering, etc.)

I claim:

1. A method of indicating correspondence between groups of controls on a control panel and results displayed in selectable colors, different colored results being associated with different groups of controls, the method comprising the steps of:

(a) selecting a first color in which a first result is displayed, the first result being associated with a first group of controls;

(b) displaying proximate the first group of controls a first visual indicator having a color similar to the first color;

(c) selecting a second color in which a second result is displayed, the second result being associated with a second group of controls; and (d) displaying proximate the second group of controls a second visual indicator having a color similar to the second color.

2. A method as in claim 1 wherein the first and second results are oscillographic traces and wherein the first and second groups of controls are associated with respective first and second input channels of an oscilloscope.

3. A method as in claim 1 wherein each displaying step comprises duty cycle modulation of a plurality of different colored LED's and also comprising combining the light from each plurality of LED's into respective single presentations.

4. A method as in claim 1 wherein each displaying step comprises controlling the intensities of a plurality of different colored incandescent lamps and also comprising combining the light from each plurality of incandescent lamps into respective single presentations.

5. A method as in claim 1 wherein the step of selecting the first color comprises rotating a shaft mechanically coupled to a first electrical color selection circuit that selects the first color and the step of displaying the first visual indicator comprises rotating a colored wheel affixed to the shaft, the only visible portion of the colored wheel being a portion corresponding to the selected first color and aligned with an aperture in the control panel.

6. A method as in claim 1 further comprising the steps of:

(e) displaying in the first color a first color source region located along the periphery of the display;

(f) displaying in the second color a second color source region located along the periphery of the display;

(g) optically coupling light from the first color source region to the first visual indicator;

(h) optically coupling light from the second color source region to the second visual indicator; and (i) wherein the displaying steps (b) and (d) each comprise emitting the light optically coupled to their respective visual indicators by steps (g) and (h).

7. A method as in claim 1 further comprising the steps of:

(e) actuating a switch in response to mechanical motion imparted to a translucent cover through which light from the first visual indicator is transmitted; and (f) altering a mode of operation in response to actuating the switch.

* * * * *